United States Patent [19]

Yen et al.

[11] 4,043,881

[45] Aug. 23, 1977

[54] ELECTROLYTIC RECOVERY OF ECONOMIC VALUES FROM SHALE OIL RETORT WATER

[75] Inventors: Teh Fu Yen, Altadena; Chaur-Shyong Wen, Los Angeles, both of Calif.

[73] Assignee: University of Southern California, Los Angeles, Calif.

[21] Appl. No.: 716,857

[22] Filed: Aug. 23, 1976

[51] Int. Cl.[2] ..... C25B 1/00; C25B 3/00

[52] U.S. Cl. ..... 204/102; 204/130; 204/131; 204/101

[58] Field of Search ..... 204/130–131, 204/136; 75/1 R, 2

[56] References Cited

U.S. PATENT DOCUMENTS 3,915,819 10/1975 Bell et al. ..... 204/136

*Primary Examiner*—R. L. Andrews

*Attorney, Agent, or Firm*—Nilsson, Robbins, Dalgarn & Berliner

[57] ABSTRACT

Evolved ammonia is recovered from the electrolysis of shale oil retort water.

9 Claims, 6 Drawing Figures

ELECTROLYTIC RECOVERY OF ECONOMIC VALUES FROM SHALE OIL RETORT WATER

FIELD OF THE INVENTION

The invention relates to oil shale treatment, and more specifically to the recovery of economic values from shale oil retort water.

BACKGROUND AND SUMMARY OF THE INVENTION

Oil shale is a natural sedimentary rock containing an abundance of residual organic material which, when processed, can be made into oil and fuel products. Typically, oil shale, such as exemplified by the Green River formation in Wyoming, Colorado and Utah, has about 15-20% organic material embedded in an inorganic mineral matrix. The organic portion is composed generally of a soluble bitumen fraction and an insoluble fraction in which kerogen constitutes the bulk of the insoluble organic material. In order to remove the organic material from the oil shale, the usual process has comprised crushing the matrix rock and subjecting the crushed matrix to heat in a retort to distill off the kerogen by destructive pyrolysis. A major waste product from oil shale retorting processes is water coproduced with the shale oil and which can also include a small amount of water originally trapped within the matrix of the oil shale. The amount of retort water formed may equal 20 to 100 barrels per 100 barrels of shale oil produced. Of course, the actual amount of retort water produced depends upon the type and operating conditions of the retorting process used as well as the location and nature of the oil shale. Since the oil shale retort water is loaded with considerable quantities of soluble organic and inorganic materials, it presents a serious major disposal problem. On the other hand, the presence of organic components, particularly nitrogenous components, presents an opportunity for recovery of economic values from the retort water which can aid in making oil shale processing operations economically feasible. Such economic feasibility is often called in question when one compares the cost of deriving useful oil products from oil shale. Accordingly, any basis for recovering of economic values constitutes a significant advantage.

A number of processes have been suggested for the treatment of retort water including chemical precipitation, solvent extraction, ion exchange and limestone neutralization. Except for special circumstances there are practical limitations in the applications of all the foregoing methods. Moreover, such methods generally require continued addition of treatment chemicals which increases the quantity of contaminants, complicates the problem of ultimate disposal and decreases the opportunity for economic recoveries.

The present invention provides a process for the recovery of economic values from shale oil retort water which does not suffer the drawbacks of the above-mentioned procedures, but usefully permits recovery of ammonia. Specifically, the shale oil retort water is delivered to an electrolytic cell and a direct current potential is applied across the anode and cathode chambers of the cell at a current density sufficient to effect a substantial decrease in the organic compounds in the retort water in the anode chamber and to evolve a substantial amount of ammonia from the retort water in the cathode chamber. The ammonia can be recovered as a valuable product of the process and can be combined with carbon dioxide evolved from the anode chamber, as a result of the oxidative electrolysis therein, to provide an economic bases for the synthesis of urea or other valuable products.

DETAILED DESCRIPTION

Figure 1:
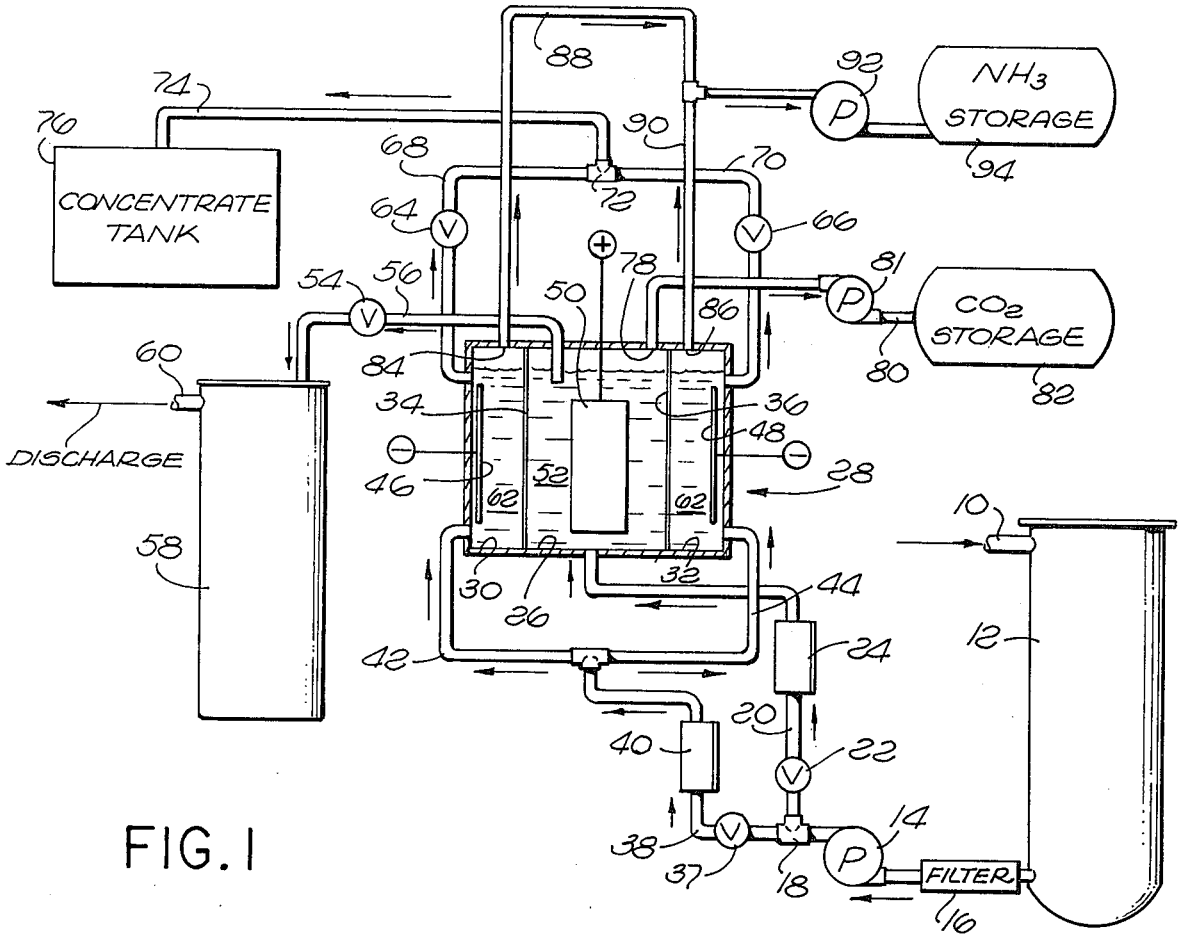
FIG. 1 is a combination block form flow diagram and schematic of apparatus used in conducting the present process.

Referring to FIG. 1, the present process is illustrated in flow format. Oil shale retort water is provided via an inlet tube 12 to a settling reservoir 10 wherein oily liquids and the like are permitted to float to the top, with aqueous portions settling to the bottom. The retort water also contains some small suspended particles of shale oil and particles of long chain fatty acid salts. To remove such particles, the water is drawn by a pump 14 through a filtering assembly shown schematically at 16. The retort water is then pumped to a branching tee 18 on one side of which it flows through piping 20 as controlled by a valve 22, through a flow meter 24 and then into the anode compartment 26 of an electrolytic cell 28. The electrolytic cell 28 is divided into an anode chamber 26 flanked by two cathode chambers 30 and 32. The chambers are defined by inert membranes 34 and 36 which divide the cell 28 into the anode and cathode chambers. The membranes are permeable to cations but are substantially impermeable to the organic components of the retort water, so as to prevent the oxidized organics from undergoing unwanted reaction at the cathode. For example, a cation-porous membrane such as sold commercially under the trademark Dupont Nafion Membrane 425 (a perfluorosulfonic acid product) can be used. Alternatively, one could use rigid porous frits, having an average porosity in the range of about 20u–100u.

As the other leg from the tee 18, the retort water flows via a valve 37 through piping 38, through a flow meter 40 and through branching arms 42 and 44 into the cathode chambers 30 and 32, respectively.

As electrodes, one can use any commonly used electrodes which are resistant to the retort water, for example, graphite, stainless steel, copper, copper-silicon, aluminum oxide, lead and the like. Platinum can be used for small production runs. For large commercial installations, carbon anodes and lead sheet cathodes can be used. In the apparatus illustrated, lead sheets define the cathodes 46 and 48 and platinum gauze defines the anode 50. A direct current potential is applied by means of a source (not shown) of electrical energy connected to the anodes and cathodes, as indicated in the drawing by electrical signals.

Anolyte 52 from the anode chamber 26 exhausts via a valve 54 through piping 56 into a settling column 58 from which it is discharged as required from outlet 60. Catholyte 62 exhausts via valve 64 and 66 through piping arms 68 and 70 joined by a tee 72 to a main conduit 74 which leads into a concentrate tank 76. Periodically, the material in the concentrate tank 76 is discharged. In the drawing, the piping arms 68 and 70 are shown above the catholyte level, but in actuality they would be directed to a lower level and the concentrate tank 76 would be at a position sufficiently below the level of liquid in the cathode chambers to permit flow of catholyte by gravity.

At the top of the anode chamber 26, a vent 78 is provided and evolved carbon dioxide is drawn through piping 80 connected to the vent 78, by means of a pump 81. The evolved carbon dioxide is pumped into a carbon dioxide storage tank 82. At the top of each cathode chamber 30 and 32, vents 84 and 86 are provided so that evolved ammonia can be drawn through piping arms 88 and 90 by means of a pump 92. The evolved ammonia is pumped into an ammonia storage tank 94.

The valves 22, 37, 54, 64 and 66, can be controlled manually or can be controlled by means of servo mechanisms associated with signals obtained from the flow meters 24 and 40, all in accordance with known engineering principles.

In operation, retort water placed in the settling reservoir 12 is pumped into the anode chamber 26 and cathode chambers 30 and 32 and is subjected to electrolysis. The current density of the applied potential generally should be above about 50 amperes per square meter (50 $A/m^2$) and can range up to 1500 $A/m^2$. Dwell time in the electrolytic cell should average at least about an hour at the higher levels of current density to several days if necessary at the lower levels, depending of course upon composition of the retort water, operating temperature, etc. With bench scale dimensions in which the anode is constituted by platinum gauze 5 centimeters square and the cathode is constituted by lead sheets $4 \times 7$ cm, under a current density of 100 $A/m^2$, a typical flow rate is 4 ml/sec.

Figure 2:
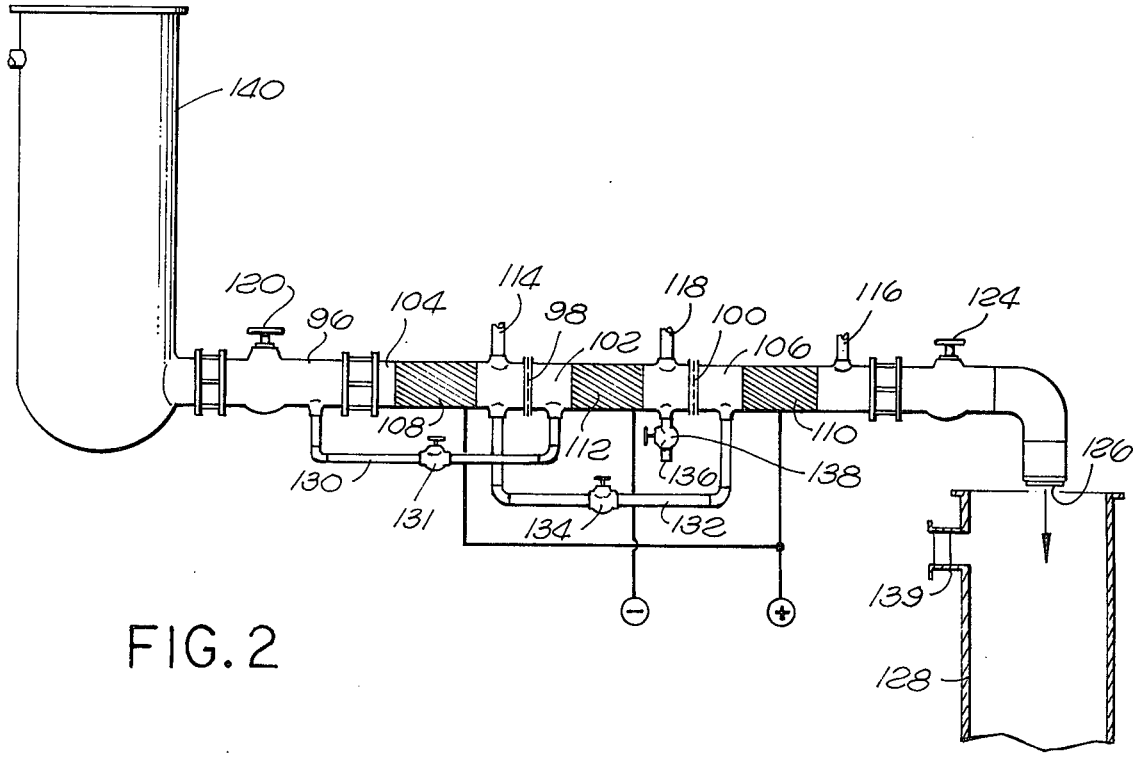
FIG. 2 is a partially elevational, partially schematic view of other apparatus for the continuous operation of the present process.

Referring now to FIG. 2, other apparatus for conducting the present process is illustrated. In this apparatus, the electrolytic cell is defined along a length of piping 96 by means of cation-porous membranes 98 and 100 of the type above referred to and which divides the piping 96 into a central cathode section 102, flanked by anode sections 104 and 106. Porous electrodes are utilized for the anodes and cathodes and they can be any of the materials previously referred to, but in a form whereby retort water can flow therepast. Thus, the anode sections 104 and 106 can have disposed therein coils 108 and 110 of copper wire, platinum gauze, or the like and the cathode section can have therein a bridge structure 112 of lead, by way of example. Gas vents 114 and 116 lead from the anode sections to a carbon dioxide storage tank in the manner described above with respect to FIG. 1. In like manner, a vent 118 leads from the cathode section to an ammonia storage tank.

Valves 120 and 124 on opposite sides of the anode sections are provided to control the flow through the system. Exhausted retort water exits through the end 126 of the conduit 96 into a settling column 128 from which the exhausted retort water can be discharged, as at 139. Since the cation membranes 98 and 100 are substantially impermeable to the flow of organic components in the retort water, a diversion conduit 130, controlled by a valve 131, provides a path for flow of the retort water from a point upstream of the anode 108 to the cathode section 102. A diversion conduit 132, controlled by a valve 134, connects the two anode sections. An exhaust conduit 136 controlled by a valve 138 permits discharge from the cathode section, downstream of the cathode, to a suitable concentrate tank (not shown). By appropriate adjustment of the valves, balanced operation can be obtained. In operation, retort water is delivered to a settling tank 140 and from there travels through the apparatus in a continuous manner. Considerations respecting current density and dwell times are based upon the factors previously enumerated.

While the composition of oil shale retort water will obviously vary depending upon diverse factors including the nature of the shale, and retort processing conditions, as a general proposition it is found that the retort water comprises about 67–75 weight percent inorganic components and about 25–33 weight percent organic components, based upon the soluble materials in the water. The organic components comprise generally about 10–15 weight percent acidic organics, about 7–10 weight percent basic organic components and about 3–5 weight percent neutral organic components, again based upon the soluble material. Table 1 lists a typical range of values.

TABLE 1

| | | | |
|---|---|---|---|
| Inorganics 67–75 (%wt) | Cations 15–25 (%wt) | $Na^+$ | 4,500 ppm |
| | | $Mg^+$ | 250 ppm |
| | | $K^+$ | 180 ppm |
| | | $Ca^+$ | ppm |
| | | $NH_4^+$ | 8,000 ppm |
| | Anions 40–55 (%wt) | $HCO_3^-$ | 16,000 ppm |
| | | $CO_3^{--}$ | 5,000 ppm |
| | | $Cl^-$ | 5,000 ppm |
| | | $SO_4^{--}$ | 1,000 ppm |
| | | $NO_3^-$ | — |
| | | $S^{--}$ | — |
| | | $F^-$ | — |
| | Trace Metals | Pb, Zn, Cu, U, Cr, Fe, Mo, As, etc. | |
| Organics 25–33 (%wt) | Acidic Organics 10–15 (%wt) | Short-chain Carboxylic Acids $C_1$–$C_{11}$ | |
| | | Long-chain Carboxylic Acids $C_{16}$–$C_{24}$ | |
| | | Phenols | |
| | Neutral Organics 3–5 (%wt) | Substituted Benzenes | |
| | | n-alkanes $C_{16}$–$C_{32}$ | |
| | Basic Organics 7–10 (%wt) | Nitrogen Base Organics, i.e. quinolines, pyridines, maleimides, succinimides, etc. | |
| | | Organic-Sulfur Compounds, i.e. thiophenes, sulfides, disulfides, etc. | |

At the anode, the major reaction is one of oxidative electrolysis in which the organic components are destructively oxidized to carbon dioxide as the final product. At the cathode, bond cleavage of the ammonium ion occurs with the addition of one electron to yield ammonia gas. In addition, hydrogen is formed at the cathode which serves to denitrogenate the organic nitrogenous compounds to generate ammonia gas. During electrolysis, the positive charge of the ammonium ion is flowed through the cation exchange member to the cathode.

Since retort water has a high conductivity, around $2 \times 10^4$ micromhos per centimeter, one can consider retort water as a simple salt. Under electric field between two electrodes, the cations migrate to the negatively charged cathode while the anions migrate in the opposite direction toward the positively charged anode. Accordingly, no electrolyte need be added.

The following examples will illustrate application of the process.

EXAMPLE 1

Electrolysis was conducted using a U-type covered cell of 500 milliliter total capacity. A cation permselective membrane was placed between anodic and cathodic chambers. A platinum gauze, 5 centimeters square, was soldered with a 10 centimeter length of 20 B & S gauge platinum wire, and served as the anode. A smooth lead sheet 4 × 7 cm. was used as the cathode. For purposes of measurement, a saturated calomel electrode was sealed in the anodic chamber for use as a reference electrode. Vents were provided in the roof of each chamber controlled by a stopcock, to collect gases evolved in each chamber.

Separate runs were conducted with retort water obtained from processing of Utah Green River oil shale and with retort water obtained from processing of Colorado Green River oil shale. 300 Milliliters of retort water was filtered through a VWR Grade No. 615 filter paper and 150 milliliters of the filtered solution was poured into each of the anodic and cathodic chambers. Since the conductivity of the original retort water was adequate, no electrolyte was added for the electrolysis. A number of runs were made in which the current density was controlled to preselected values by varying the potential. Thus, runs were made in which the current density was at 10, 12, 14, 16 or 20 Ma/cm$^2$ (100, 120, 140, 160 and 120 A/m$^2$). Electrolysis was conducted for 10 hours for each run. Additionally, further runs were conducted in which a current density of 20 Ma/cm$^2$ was maintained for times of 3, 5, 8 and 10 hours.

Upon completion of the electrolysis for each run, samples of the solution were drawn off. Each 100 milliliters of anodic and cathodic treating sample was lyophilized and then extracted with benzene to permit gas chromatographic and other instrumental analyses. The remaining portion of each sample was analyzed for other properties including, among others, COD (chemical oxygen demand) and color intensity.

In addition to the foregoing runs, a bench-scale continuous cell, as depicted in FIG. 1, was also used for the processing of some samples. Lead sheets were used as cathodes and a platinum gauze as the anode. The rate of flow was kept at approximately 4 milliliters per second. The other parameters were the same as those used for the batch U-type cell.

Table 2 summarizes the results of anodic treatment of retort water at a current density of 20 Ma/cm$^2$, at a cell voltage of approximately 15 volts, and a treatment time of about 10 hours.

TABLE 2

| | Organic Carbon (%wt) | Nitrogen (%wt) | Total Solid Residue (%wt) | COD (mg/l) | Benzene Soluble Material (%wt) | Color Intensity |
|---|---|---|---|---|---|---|
| Original Retort Water | 9.16 | 19.48 | 1.68 | 16,600 | 0.48 | 3441 |
| Anodic Solution | 0.42 | 1.88 | 1.05 | 6,283 | 0.05 | 255 |
| Cathodic Solution | 4.04 | 22.98 | 2.01 | 9,991 | 0.24 | 1214 |

Figure 3:
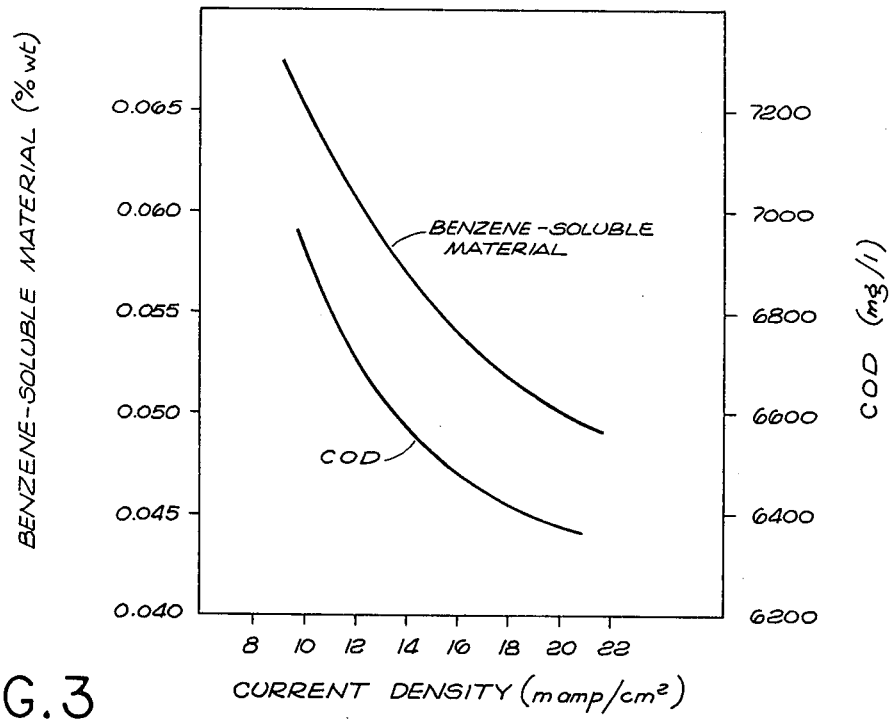
FIG. 3 is a plot of benzene-soluble organic components in the anolyte versus current density.

Referring to FIG. 3, results are shown from a series of runs made with a fixed 10 hour treatment time under various current densities. Benzene-soluble organics as well as COD is plotted versus the current density in Ma/cm$^2$. The best mathematical representation of the data in FIG. 3 can be written as $$\ln(\mathrm{COD}) = 8.36 - 0.13 \ln I$$

where $I$ is the current density in Ma/cm$^2$ and COD is the chemical oxygen demand in mg/1.

Figure 4:
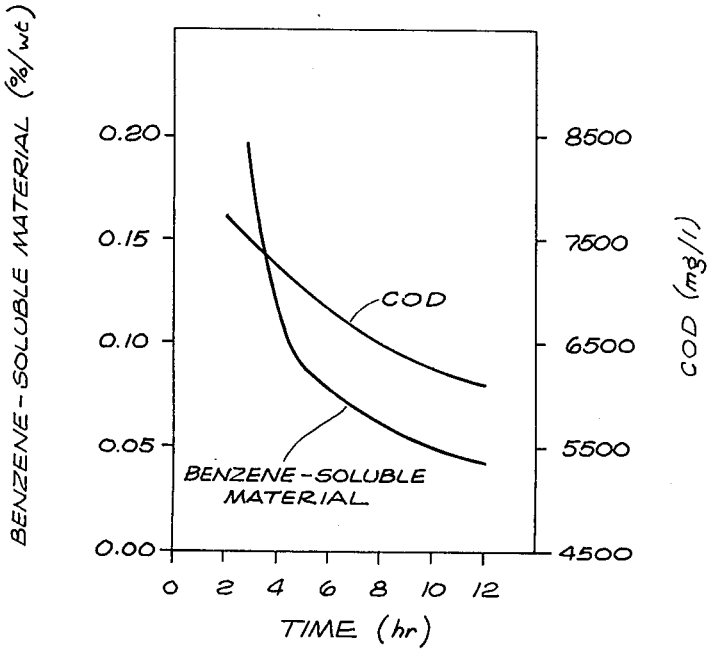
FIG. 4 is a plot of benzene-soluble organic components in the anolyte versus electrolysis time.

Referring to FIG. 4, results are shown from a series of runs made in which the current density is fixed at 20 Ma/cm$^2$ and which the time of electrolysis was varied. The best mathematical representation of the data in FIG. 4 can be written as:

$$\ln(\mathrm{COD}) = 8.99 - 0.025t$$

Figure 5:
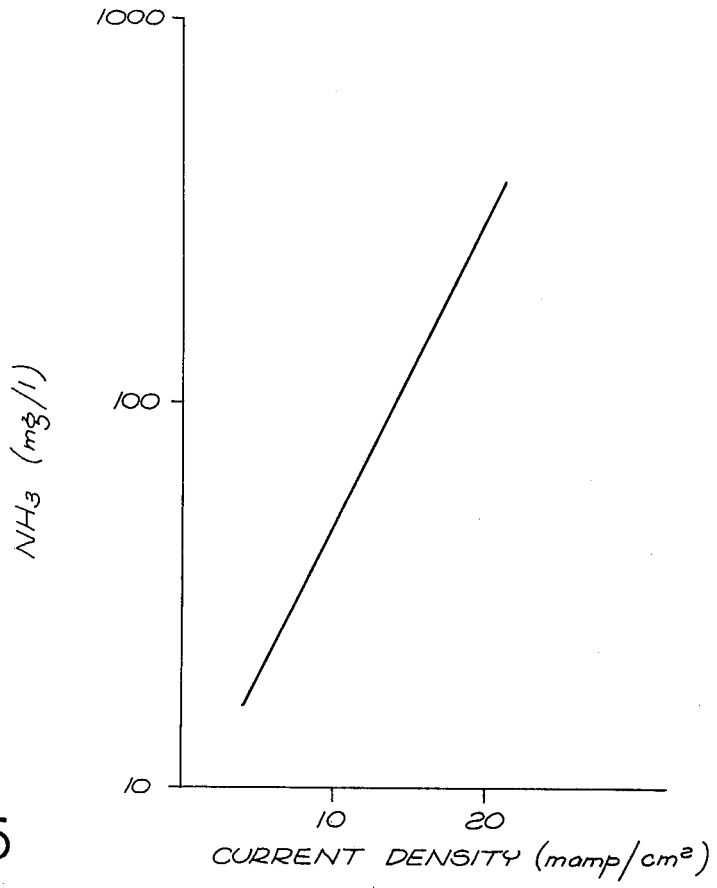
FIG. 5 is a plot of ammonia generation from the catholyte versus current density.
Figure 6:
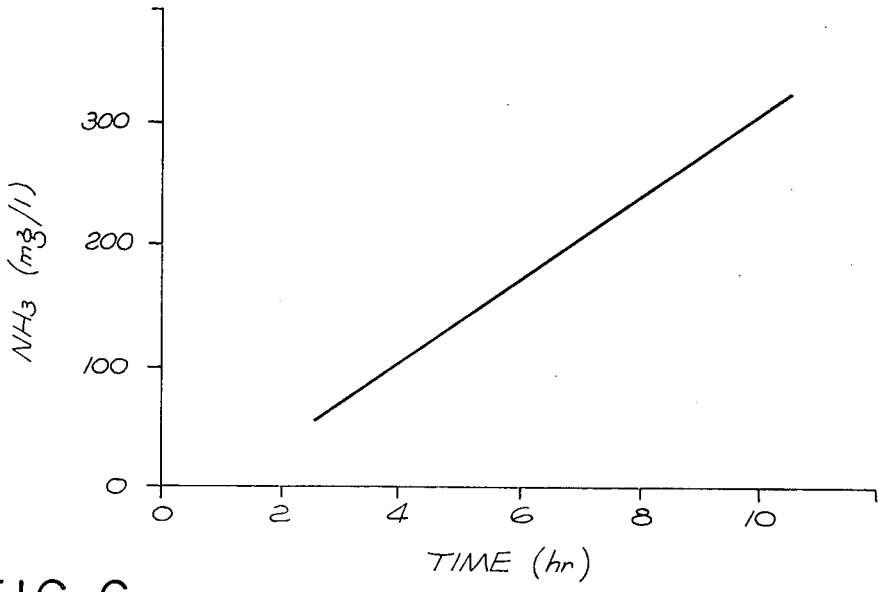
FIG. 6 is a plot of ammonia generation from the catholyte versus electrolysis time.

In FIG. 5, the results are shown for collection of ammonia at different current densities at a fixed time of about 10 hours. In FIG. 6, results are shown for the collection of ammonia at different treatment times under a fixed current density of 20 Ma/cm$^2$. These plots indicate that the amount of ammonia collected is in linear proportion to the electrolysis time, but is in logarithmic proportion to the applied current density.

Upon completion of the foregoing electrolysis, over 40–50% of the total solid residue and 80–90% of the benzene soluble organics had been removed in the anodic solution with a reduction of COD value of about 65%. Ammonia gas recovered from the cathodic chambers can be collected at an approximate value of 1,100 milligrams per gallon of retort water. The color intensity of the retort water in the visible range has been reduced approximately 92–95%.

Various modifications, changes and alterations can be made in the present process and in its steps and parameters. All such modifications, changes and alterations as are within the scope of the appended claims form part of the present invention.

We claim:

1. A process for the recovery of economic values from shale oil retort water, said retort water including soluble material comprising substantial portions of inorganic, acidic organic and basic organic components, said process comprising:

defining an electrolytic cell having a cathode chamber electrolytically operative with an anode chamber, an anode in said anode chamber and a cathode in said cathode chamber, each disposed for contacting aqueous solution therein;

delivering said shale oil retort water to said cell as said aqueous solution;

applying a direct current potential across said anode and cathode chambers at a current density above about 50 A/m$^2$ for a time sufficient to effect a substantial decrease of organic compounds in the retort water in said anode chamber and to evolve a substantial amount of ammonia from the retort water in said cathode chamber; and recovering said evolved ammonia.

2. The process of claim 1 in which said retort water includes suspended particles of shale oil and acid salts, and including the step, prior to said electrolysis, of separating said suspended particles from said retort water.

3. The process of claim 1 in which said evolved ammonia is recovered by venting of said cathode chamber.

4. The process of claim 1 in which carbon dioxide is vented from said anode chamber.

5. The process of claim 1 in which said anode and cathode chambers are separated by a cation-porous membrane which is substantially impermeable to said organic components.

6. The process of claim 1 in which said aqueous solution consists essentially of said shale oil retort water.

7. The process of claim 1 in which the soluble material of said oil shale retort water comprises about 67–75 weight percent inorganic components and about 25–33 weight percent organic components, based on said soluble material.

8. The process of claim 1 in which said organic components comprise about 10–15 weight percent acidic organics, about 7–10 weight percent basic organic components and about 3–5 weight percent neutral organic components, based on said soluble material.

9. A process for the recovery of economic values from shale oil retort water, said retort water including soluble material comprising about 67–75 weight percent inorganic components, about 10–15 weight percent acidic organic components, about 7–10 weight percent basic organic components and about 3–5 weight percent neutral organics, and containing suspended particles of shale oil and acid salts, said process comprising:

defining an electrolytic cell having a cathode chamber electrolytically operative with an anode chamber, separated by a cation-porous membrane which is substantially impermeable to said organic components, an anode in said anode chamber and a cathode in said cathode chamber, each disposed for contacting aqueous solution therein;

separating said suspended particles from said retort water;

delivering an aqueous solution, consisting essentially of said shale oil retort water, to said cell;

applying a direct current potential across said anode and cathode chambers at a current density above about 50 $A/m^2$ for a time sufficient to effect a substantial decrease of organic compounds in said retort water in said anode chamber and to evolve a substantial amount of ammonia from the retort water in said cathode chamber;

venting carbon dioxide from said anode chamber; and venting said cathode chamber and recovering said evolved ammonia therefrom.

* * * * *

UNITED STATES PATENT AND TRADEMARK OFFICE

CERTIFICATE OF CORRECTION

PATENT NO. : 4,043,881

DATED : August 23, 1977

INVENTOR(S) : Teh Fu Yen et al

It is certified that error appears in the above-identified patent and that said Letters Patent are hereby corrected as shown below:

Col. 4, line 30, "$Ca^+$ ppm" should be --$Ca^+$ 120 ppm--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*